US005412548A

United States Patent [19]

Yee

[11] Patent Number: 5,412,548

[45] Date of Patent: May 2, 1995

[54] MULTI-FUNCTION LIGHTING DEVICE

[76] Inventor: Vincent M. Yee, 14122 D. Marquesas Way, Marina Del Rey, Calif. 90292

[21] Appl. No.: 79,043

[22] Filed: Jun. 21, 1993

[51] Int. Cl.[6] ..... F21L 7/00

[52] U.S. Cl. ..... 362/202; 362/186; 362/187; 362/277

[58] Field of Search ..... 362/186, 187, 188, 196, 362/197, 198, 202, 204, 208, 253, 277, 319, 800

[56] References Cited

U.S. PATENT DOCUMENTS

| | | | |
|---|---|---|---|
| 1,248,688 | 12/1917 | Ludescher | 362/187 |
| 2,326,343 | 8/1943 | Eichenberger | 362/187 |
| 4,307,439 | 12/1981 | Sassmannshausen | 362/186 |
| 4,388,674 | 6/1983 | Sano | 362/186 |
| 4,530,039 | 7/1985 | Shin-Shi | 362/187 |
| 4,609,976 | 9/1986 | Geissler | 362/202 |
| 4,984,141 | 1/1991 | Lai et al. | 362/187 |
| 5,001,612 | 3/1991 | Odlum | 362/187 |
| 5,161,879 | 11/1992 | McDermott | 362/800 |
| 5,205,640 | 4/1993 | Shin | 362/202 |
| 5,224,773 | 7/1993 | Arimura | 362/800 |

FOREIGN PATENT DOCUMENTS

| | | | |
|---|---|---|---|
| 1045860 | 7/1953 | France | 362/204 |

*Primary Examiner*—Ira S. Lazarus
*Assistant Examiner*—Alan B. Cariaso
*Attorney, Agent, or Firm*—Robert Schaap

[57] ABSTRACT

A multi-function lighting device in the nature of a miniature flashlight and which can serve as a miniature lantern or lamp, as well as a miniature flashlight, and as a miniature signaling device. The lighting device includes a housing with a head for directing light axially outwardly in the nature of a collimated beam, so that the device can function as a flashlight. Connected to the head end is a transparent or translucent sleeve which is slidable with respect to the light source. Thus, when the head and the sleeve are shifted axially outwardly, the light source is located within the transparent or translucent sleeve. When the light source is energized, light will emanate primarily through the translucent or transparent sleeve and the amount of light emanating from the head end is substantially reduced. The device is also effective to operate as a signaling device in which the light is energized and de-energized in a sequencing or so-called "blinking" operation. Various embodiments of the device are disclosed.

15 Claims, 5 Drawing Sheets

MULTI-FUNCTION LIGHTING DEVICE

BACKGROUND OF THE INVENTION

1. Field of the Invention

This invention relates in general to certain and useful improvements in a multi-function lighting device and more particularly, to a lighting device which is miniature in size and can be hand-held and capable of operating as a flashlight or a lantern, or as a signaling device.

2. Brief Description of the Prior Art

Almost since the advent of dry cell batteries, numerous types of commercially available flashlights have been in existence. The conventional flashlight usually includes a head containing a source of light such as a light bulb fitted within a polished reflector. The elongate handle of the flashlight is designed to contain one or more dry cell batteries which energize the light source when a switch is actuated. In general, the basic operation and structure of the flashlight has changed very little since the initial inception of the flashlight and the improvements have largely been devoted only to the components used in the flashlight, such as the switches, lenses or the like.

There have been several proposed and commercially available flashlights in which the head is hingedly connected to the body by a somewhat flexible strap. In this way, the head can be spaced apart from the body of the flashlight, but connected to the power source in the flashlight through conductors in the flexible strap. However, these devices are still single function devices in that they can only function as a flashlight.

Heretofore, there has not been any multi-function lighting device which can operate as a lantern or as a signaling device or as a flashlight itself. Most flashlights are single function in that they are designed to generate a beam of light extending axially outwardly from the head of the flashlight. While most flashlights are effective for that purpose, they are also generally limited to that purpose.

There have also been several embodiments of a so-called "miniature flashlight" in which relatively small batteries are included in the handle or housing of the flashlight and which operate a light bulb fitted within a reflector in the head end or so-called "head" of the flashlight. Exemplary of this type of flashlight is U.S. Pat. No. 4,851,974, U.S. Pat. No. 4,656,565, and U.S. Pat. No. 4,658,336. These flashlights primarily differ from the conventional flashlight which uses a manually actuable off/on switch by the provision of a switch mounted within the head. In this way, the switch is actuated and the light bulb is energized or de-energized in response to rotation of the head. Beyond this, the flashlight is still a single function flashlight in that it only serves to generate light extending axially from the head end of the flashlight.

There has been a need for a lighting device which is small in size and which is hand-held and can be easily carried on an individual. Further, there has been a need for a lighting device of this type which can function not only as a flashlight, but also as a lantern or a signaling device.

Light from a flashlight can only travel a relatively short distance and moreover, the batteries have a limited life span when generating power for an incandescent light source. Further, they are not effective for generating a signal at a long distance. As a result, there is also a need for a device which can operate as a lantern or as a signaling device and which is capable of generating light which can be seen for some distance. In this way, the lighting device can act as a type of emergency warning device. Further, this type of device can also be used effectively by peace officers, traffic control officers, guides for landing aircraft, etc.

OBJECTS OF THE INVENTION

It is, therefore, one of the primary objects of the present invention to provide a multi-function lighting device which can operate as a flashlight and which can also operate as a type of lantern.

It is another object of the present invention to provide a multi-function lighting device of the type stated which is capable of operating as a flashlight for emitting a strong beam of light from a light source at a reflector axially outwardly from the lighting device and which can also be used to generate radially propagated light at a transparent or translucent section mounted within the housing.

It is a further object of the present invention to provide a multi-function lighting device of the type stated in which a small amount of attenuated light can emanate from the head end of the lighting device to function as a flashlight while the device also operates as a lantern.

It is also an object of the present invention to provide a lighting device of the type stated which is capable of functioning as a signaling device, or even an entertainment light device, and which resides in the use of an elongate handle and a transparent or translucent tube permitting distribution of light therefrom.

It is an additional object of the present invention to provide a lighting device of the type stated which is capable of generating light, either radially or axially, or both.

It is still another object of the present invention to provide a multi-function lighting device of the type stated which can utilize either conventional light bulbs or light-emitting diodes for purposes of generating and emitting light and which, when operated with a simple battery source of power, will have a very long life span.

It is still a further object of the present invention to provide a lighting device of the type stated which can find widespread use in a variety of environments including, for example, boating, police matters, and in other environments were a controlled about of lighting from a portable light source is required.

It is still a further object of the present invention to provide a method of operating a lighting device so that the device can operate as a lantern, or as signaling device, or as a flashlight.

With the above and other objects in view, my invention resides in the novel features of form, construction and arrangement and combination of parts presently described and pointed out in the claims.

BRIEF SUMMARY OF THE INVENTION

The present invention, in a broad aspect, relates to a multi-function lighting device. In this case, the lighting device can operate as a flashlight or the device can operate as a lamp or so-called "lantern." In still another embodiment of the invention, the lighting device can operate as a type of signaling device. The present invention is also effective in that the lighting device can actually function as a type of entertainment lighting device.

In the present invention, the term "signaling", as used in connection with a signaling device, is used in the context of sending an advisory signal, such as a warning signal or an emergency light signal. The term "entertainment", as used in connection with the lighting device of the invention, is also used in a broad context to refer to entertainment lighting, as well as amusement lighting.

The lighting device of the present invention is a preferred embodiment is effectively designed with a size and shape somewhat similar to that of a flashlight, such as a miniature flashlight. To that extent, the lighting device has an elongate handle and a head. The head is provided with a reflector containing a source of light and a transparent lens permitting light to be axially directed therefrom. To this extent, the lighting device of the present invention is effective in that it will operate suitably as a flashlight.

The handle or housing of the lighting device is elongate and tubular so as to house one or more dry cell batteries. These batteries function to provide a source of electrical power. However, alternately, the device could be constructed so as to utilize conventional household power, or other forms of 110 volt AC electrical power, or other types of hard-wired electrical power. Further, the device could actually be provided with one or more solar cells for providing the solar generated electrical power.

The head end of the lighting device of the present invention is axially shiftable relative to the remainder of the housing and particularly the handle. Moreover, a transparent or translucent sleeve is shiftable with the head end of the lighting device and relative to a source of light. When the lighting device is operable as a flashlight, the transparent sleeve is actually disposed over a portion of the elongate housing, and particularly that portion which serves as a handle. However, when the lighting device is to be used as a lantern or lamp, the head end is shifted axially outwardly away from the handle. In like manner, the sleeve is also axially shifted. As this occurs, the source of light is then effectively moved away from a reflector in the head and located within the sleeve.

Inasmuch as the sleeve is transparent or translucent, light will be generated radially outwardly from the sleeve. Moreover, due to the fact that the source of light has been effectively shifted axially away from the head, and particularly the reflector, very little light will emanate outwardly from the lens of the lighting device and the light which does emanate will be more axially directed and will not spread in the same manner as a conventional flashlight. Thus, and in this way, the lighting device of the present invention can simultaneously function both as a lantern and as a flashlight.

The transparent or translucent sleeve may be splined or formed with a surface irregularity so that it is truly translucent. In this way, the light which is generated at the light source will be widely dispersed and diffused. Therefore, an observer cannot readily see the light source. Rather, the observer will only see the diffused light emanating from the sleeve itself.

The lighting device of the invention is not necessarily limited to a shape which is circular, as in a conventional flashlight. Rather, the lighting device can be elongate and can be provided with a triangular shape or other shaped sleeves. Moreover, the transparent or translucent sleeve may be provided with a unique surface configuration, such as with diamonds or the like. Moreover, various forms or figures can be imprinted on or otherwise actually formed in the sleeve itself.

The lighting device of the invention may also be provided with a simple electronic sequencing circuit. In this way, the light source itself will sequence in an on and off or so-called "blinking" condition. Thus, a type of strobing effect will be created, as opposed to a lantern effect. In this way, the lighting device of the present invention can actually operate as a signaling device.

In another embodiment of the invention, the lighting device can utilize high energy light-emitting diodes. In this way, the batteries will only use a very small amount of electrical power to energize the diodes. Various types of light-emitting diodes can be employed and various colors of light-emitting diodes may also be employed. For example, the light-emitting diodes may be red, green, blue, or, for that matter, even white. By use of the light-emitting diodes, the device will have a long life span. This is particularly effective where the device may be used as an emergency warning device or signaling device. Indeed, it has been found that the lighting device of the present invention may have a life span of 20 times of that of a conventional flashlight.

The device is provided with a suitable switch means for energizing the light source. In this case, the switch means is actually incorporated in a rotatably actuated switch at the head end of the lighting device. One form of switch mechanism which may be used is more fully illustrated and described in U.S. patent application Ser. No. 782,983 filed Oct. 28, 1991, now U.S. Pat. No. 5,205,640, entitled "Miniature Flashlight." In this case, by slight rotation of the head in one direction or the other, the battery source of power is brought into contact with the light source, such as a light bulb or light-emitting diode. When further rotated, the battery source of power is removed from contact with the light source, thereby permitting the light source to be de-energized.

The sequencing circuit is interposed between the batteries or other source of electrical power associated with the handle and the light source. When actuated, the battery will cause the light source to sequentially operate by turning on and off on a continuous basis. Further, the device is constructed so that the light can remain on or off for a substantial period of time. The device can be constructed so that the frequency of sequencing is variable. Moreover, the device may be provided with a control so that the user may control the frequency of strobing. In addition, a sensitivity circuit may also be included in the lighting device of the invention. In this way, the user can control the amount of light emitted from the device for a particular environment. As a simple example, if a peace officer examining a document in a vehicle may immediately wish to scan the dark exterior environment. If his or her eyes were conditioned to a bright light, there would be a steady-state delay time before such peace officer could literally examine a darker surrounding.

The lighting device of the present invention may also be provided with one or more supporting means for supporting the lighting device on a fixed structure. Various types of supporting means may be employed as, for example, suction cups, spikes for driving into the ground, tripods and the like. Certain of these supporting devices are hereinafter described in more detail. In this way, the lighting device can be mounted on a high structure if needed to operate as a type of warning or signaling device.

The present invention possesses many other advantages and has other purposes which will be made more clearly apparent from a consideration of the forms in which it may be embodied. Several of these forms are illustrated and described in the following detailed description and in the accompanying drawings. However, it is to be understood that these drawings and the detailed description are set forth only for purposes of illustrating the general principles of the invention and are not to be taken in a limiting sense.

BRIEF DESCRIPTION OF THE DRAWINGS

Figure 1:
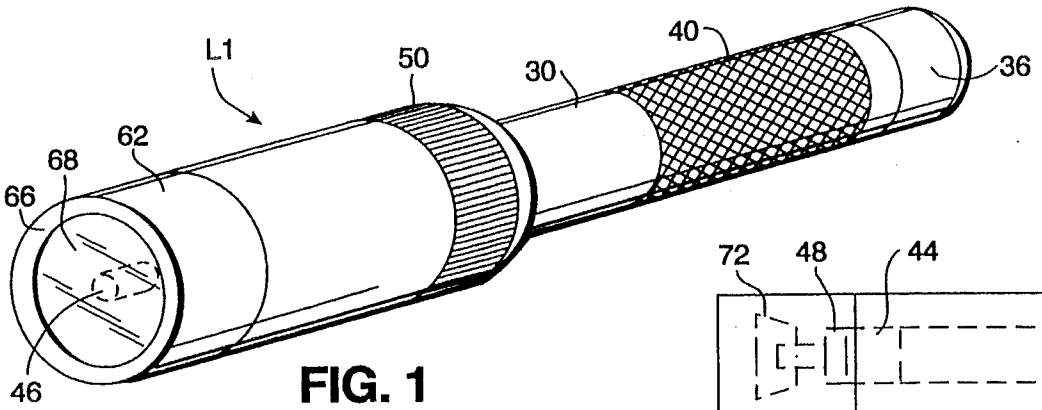
Figure 2:
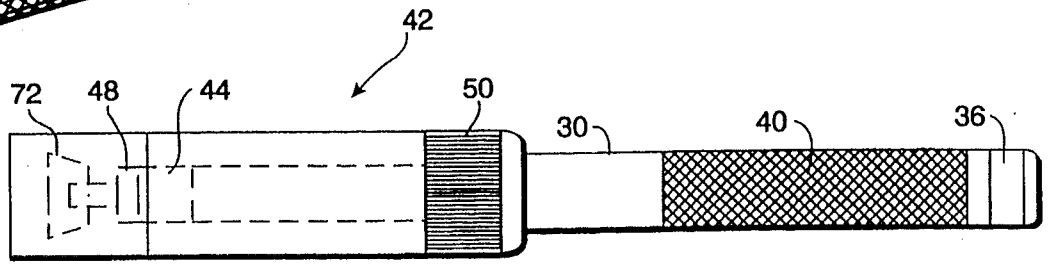
Figure 3:
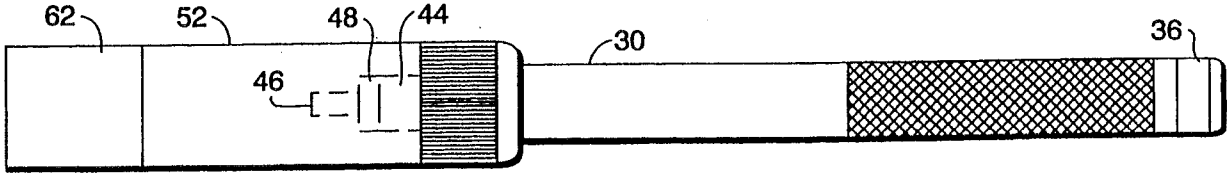
Figure 4:
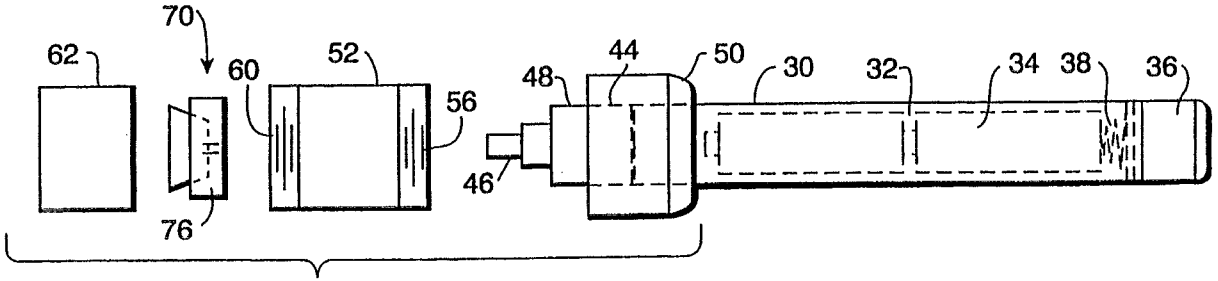
Figure 5:
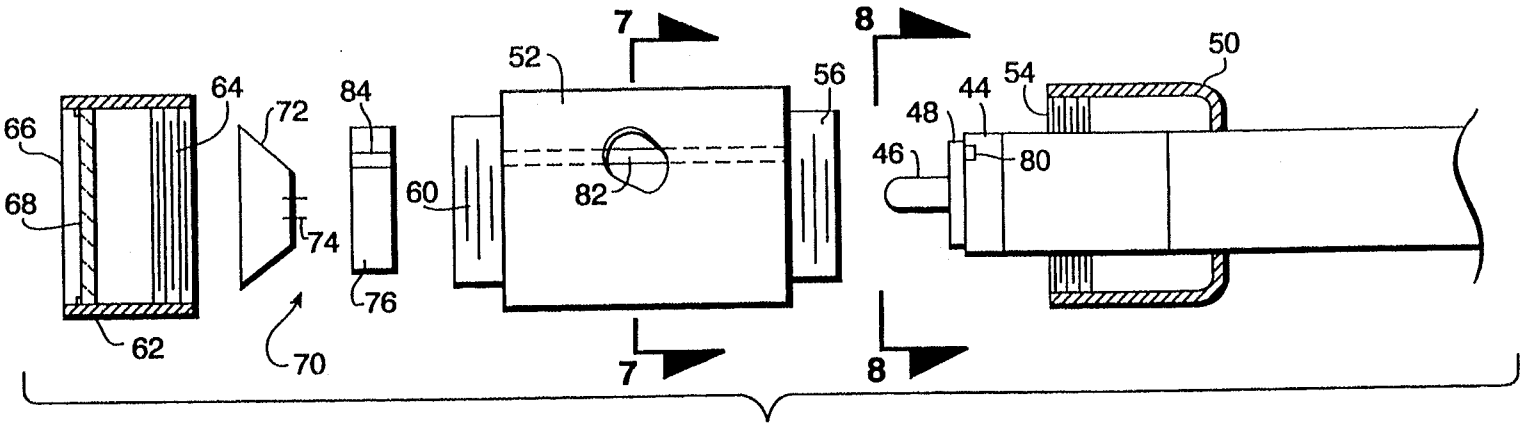
Figure 9:
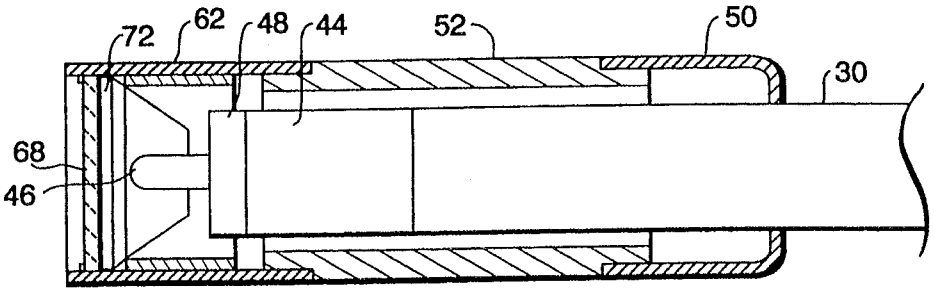
Figure 10:
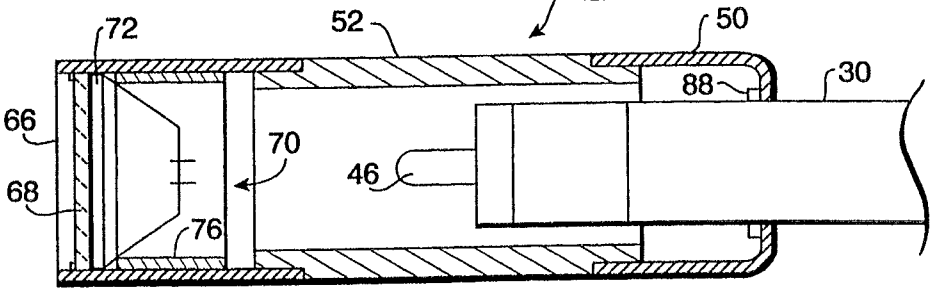
Figure 8:
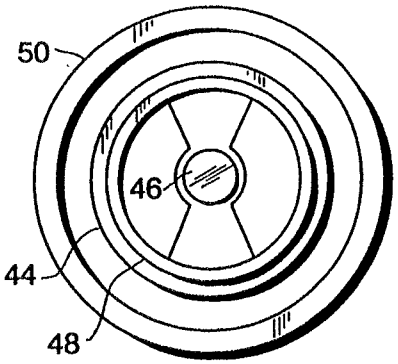
Figure 6:
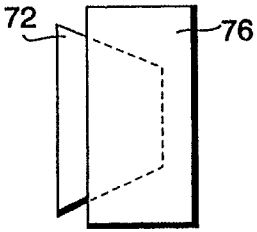
Figure 7:
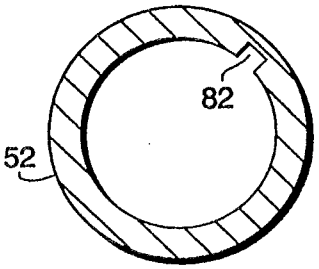
Figure 11:
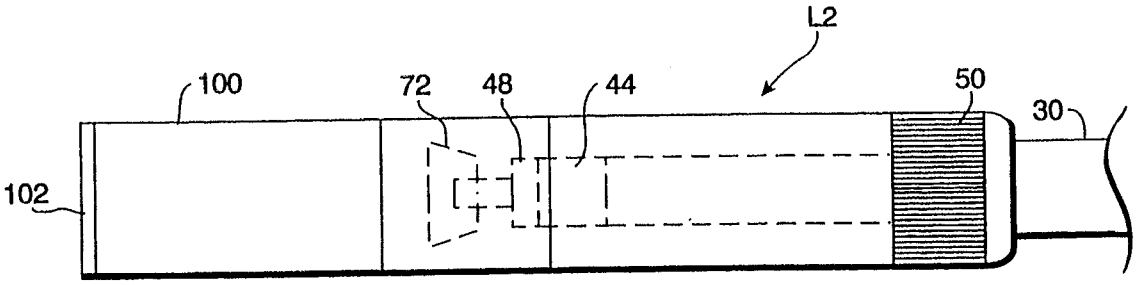
Figure 12:
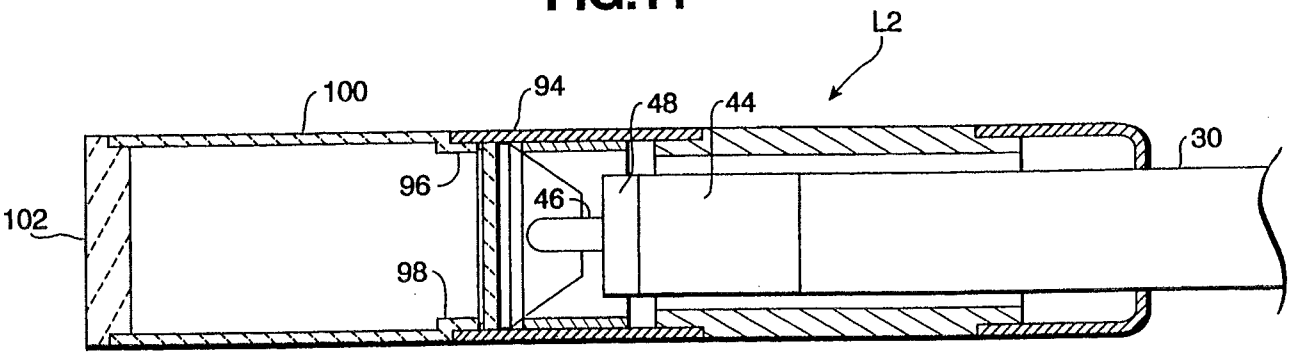
Figure 13:
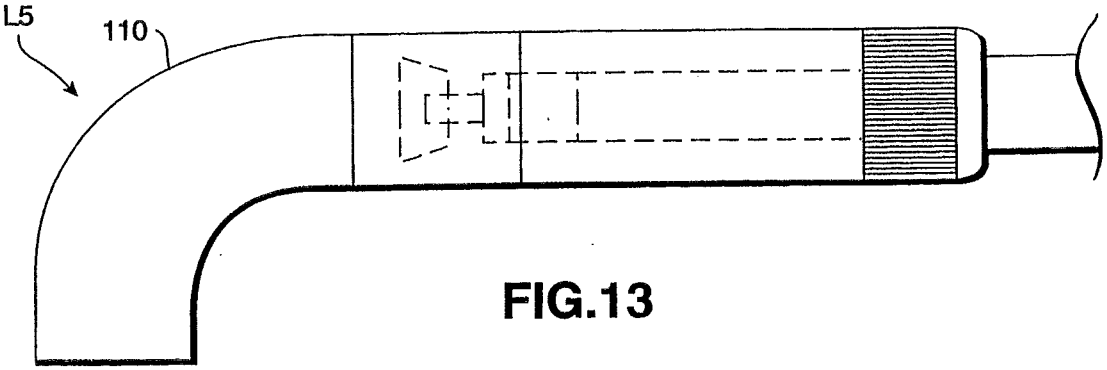
Figure 14:
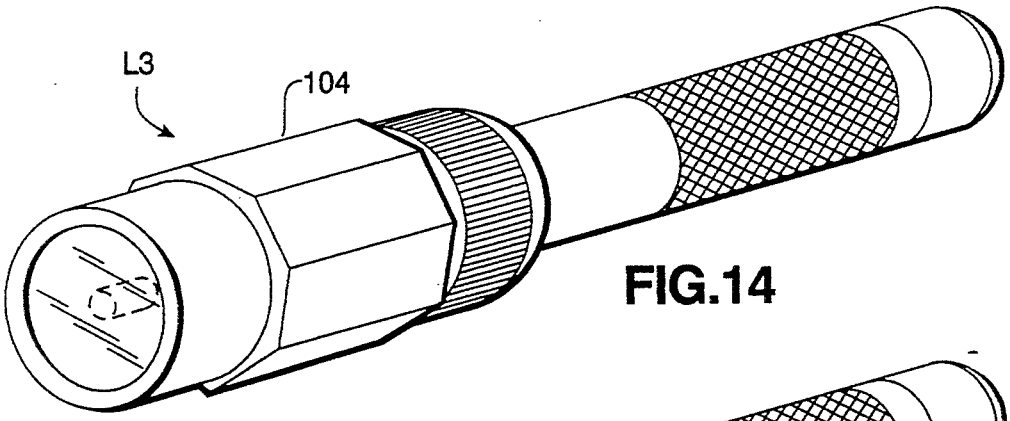
Figure 15:
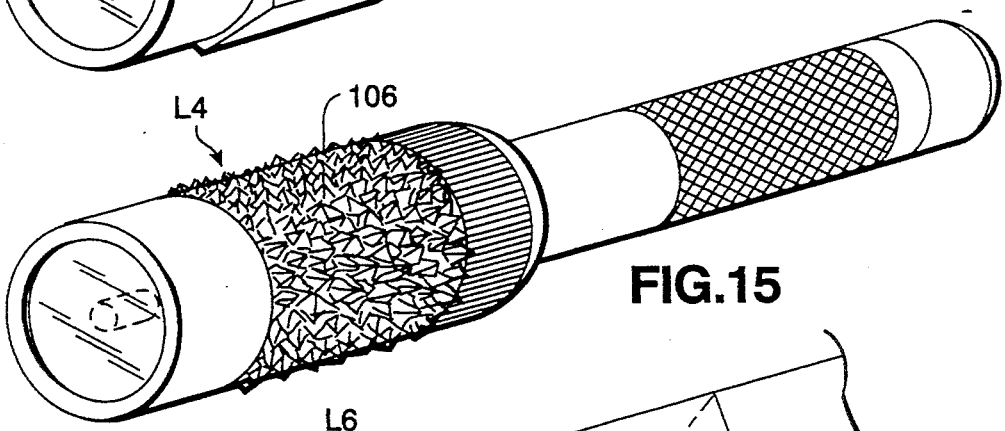
Figure 16:
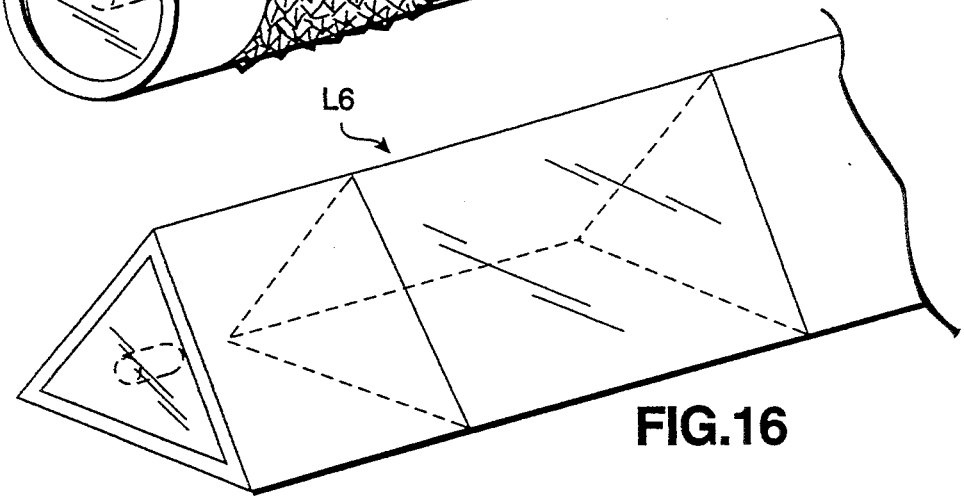
Figure 17:
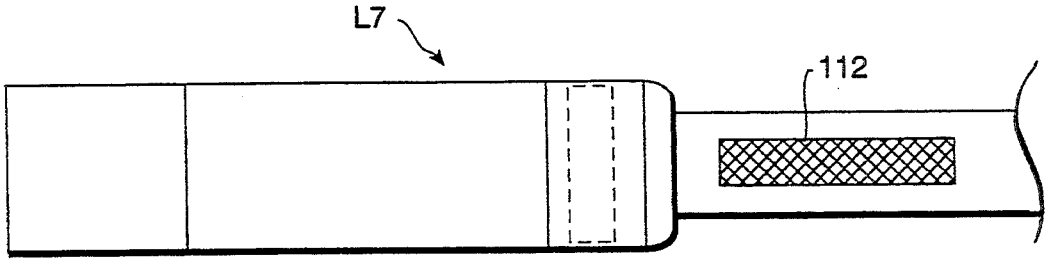
Figure 18:
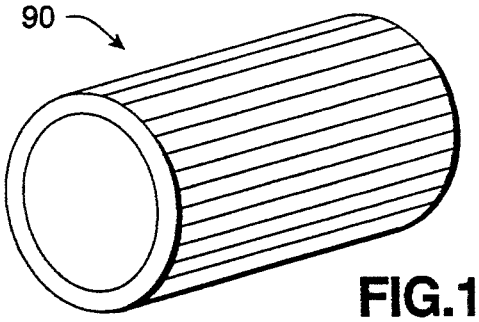
Figure 19:
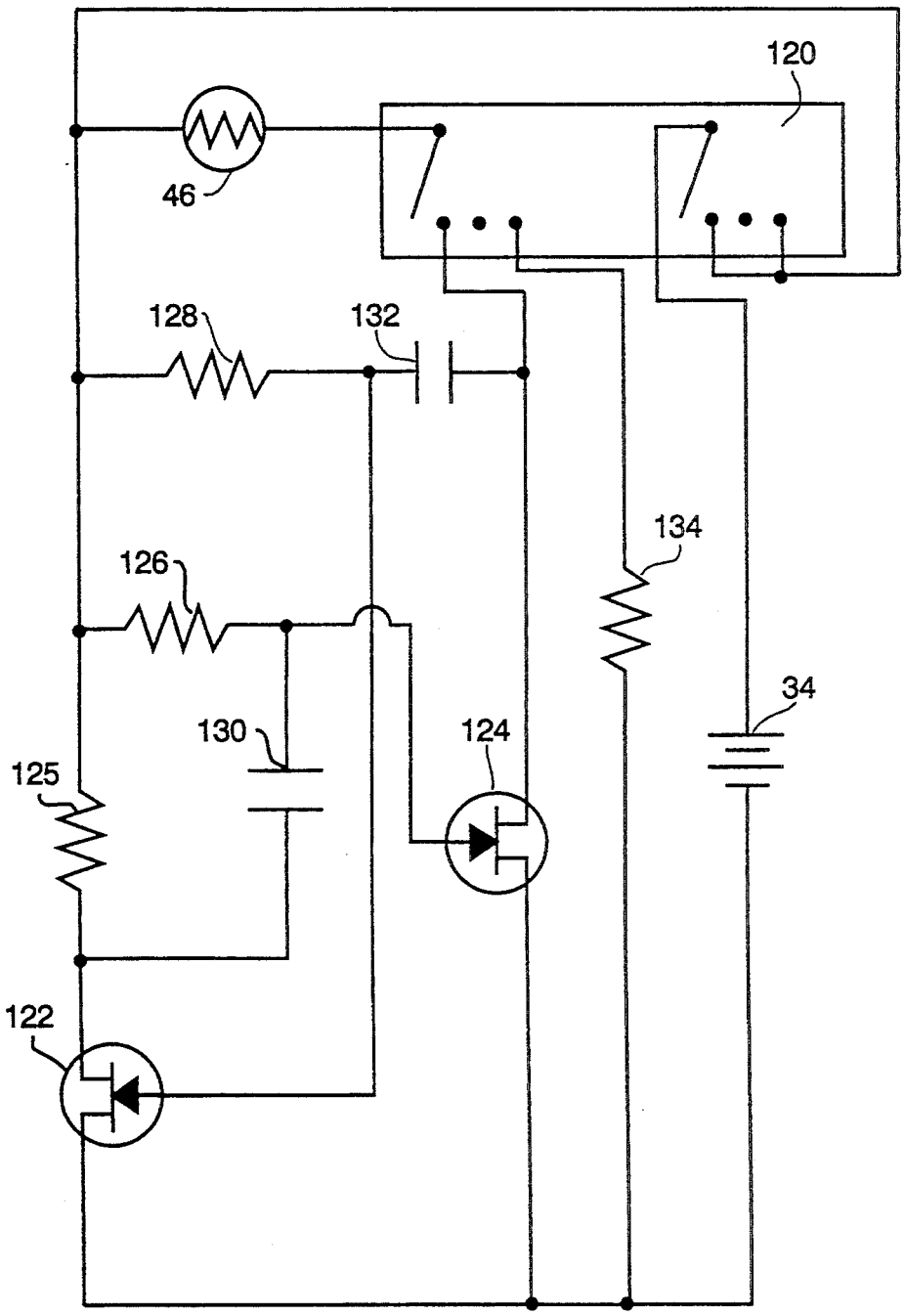

Having thus described the invention in general terms, reference will now be made to the accompanying drawings in which:

FIG. 1 is a perspective view of a multi-function lighting device constructed in accordance and embodying the present invention;

FIG. 2 is a side elevational view of the lighting device of FIG. 1 when operated in a mode of a flashlight;

FIG. 3 is a side elevational view of the lighting device showing the lighting device when operating in a mode as a lantern or a signaling device;

FIG. 4 is an exploded side elevational view showing the arrangement of assembly of several of the components forming part of the lighting device;

FIG. 5 is an exploded side elevational view showing several of the portions of the lighting device with some of the portions being shown in vertical section;

FIG. 6 is a side elevational view of a reflector assembly used in the lighting device of the invention;

FIG. 7 is a sectional view taken line 7—7 of FIG. 5;

FIG. 8 is a planar view showing a portion of the light source and taken substantially along the plane of line 8—8 of FIG. 5;

FIG. 9 is a sectional view showing the arrangement of the components when the lighting device is used in the mode of a flashlight;

FIG. 10 is a sectional view, somewhat similar to FIG. 9, and showing the arrangement of the components when the lighting device is used in the mode of a lantern or signaling device;

FIG. 11 is a fragmentary elevational view of a slightly modified form of lighting device constructed in accordance with and embodying the present invention;

FIG. 12 is a fragmentary sectional view showing a portion of the lighting device of FIG. 11;

FIG. 13 is a fragmentary side elevational view showing another modified form of lighting device constructed in accordance with and embodying the present invention;

FIG. 14 is a fragmentary perspective view showing still a further modified form of lighting device constructed in accordance with and embodying the present invention;

FIG. 15 is a fragmentary perspective view showing still another modified form of lighting device constructed in accordance with and embodying the present invention;

FIG. 16 is a fragmentary perspective view showing still another modified form of lighting device of the present invention;

FIG. 17 is an elevational view showing yet another embodiment of a lighting device of the present invention;

FIG. 18 is a fragmentary perspective view showing a surface configuration of the sleeve used in the lighting device of the present invention; and FIG. 19 is a schematic view of a circuit arrangement used with the lighting device of the invention.

DETAILED DESCRIPTION OF PREFERRED EMBODIMENTS

Referring now in more detail, and by reference characters to the drawings which illustrate several practical embodiments of the present invention, $L_1$ designates a lighting device which, in the illustrated embodiment, has a shape somewhat similar to that of a conventional flashlight, and particularly a conventional miniature flashlight. The lighting device of the present invention, however, is not so limited as previously described, and may be operated as a lantern or as a signaling device, as well.

In the illustrated embodiment, the lighting device $L_1$ comprises an elongate handle 30 which is hollow and contains an interior chamber 32 for holding one or more dry cell batteries 34. The dry cell batteries 34 can be inserted into the elongate handle 30 in a conventional fashion by means of a removable cap 36 at one end. The removable cap 36 is conventionally provided with a contactor plate and spring arrangement 38.

The elongate handle 30 may also be provided with a knurled section 40 to enable grasping movement by a user. For that matter, any type of conventional surface arrangement can be used on the elongate handle 30.

At its opposite end, the lighting device $L_1$ is provided with an enlarged head section 42. In the illustrated embodiment of the lighting device $L_1$, the head section 42 is illustrated and described as being enlarged. However, it should be understood that the head section could have the same diametral size as the body itself or, for that matter, it could have a size which is even smaller then the body itself. The enlarged head section 42 is comprised of several components which are more fully illustrated in FIGS. 4–8 of the drawings. In this case, a fitting 44 is secured to one end of the elongate handle 30. The fitting 44 actually contains the circuit electronics for performing sequencing operations, as hereinafter described. In the absence of a sequencer, the fitting 44 would only serve to house a conductor from the dry cell batteries 34 to a conventional light bulb, or other form of light source 46. The light source 46 is conventionally mounted within a bayonet-type adapter 48 secured to and extending axially outwardly from the fitting 44.

A slidable coupling 50 is longitudinally shiftable over the elongate handle 30. This slidable coupling 50 is secured to and shiftable with an axially extending elongate sleeve 52. In this case, the axially extending elongate sleeve 52 is preferably transparent or translucent, as previously described and as also hereinafter described in more detail. The coupling 50 is provided with an internally threaded section 54 and threadedly engages a diametrically reduced axially extending threaded section 56 on the elongate sleeve 52. In this way, the slidable coupling 50 and the elongate sleeve 52 are slidably shiftable along the elongate handle 30 to a limited degree, as hereinafter described.

At its opposite end, the elongate sleeve 52 is provided with a diametrically reduced externally threaded section 60 for threaded securement to and end cap 62. In this case, and by reference to FIG. 5, it can be seen that the end cap 62 is provided with an internally threaded section 64 for mating threaded engagement with the externally threaded section 60 on the elongate sleeve 52.

The end cap 62 is somewhat cylindrical in shape and is initially provided with an open end 66 facing outwardly away from the elongate handle 30. A plastic or glass lens 68 is disposed within the end cap 62 and effectively closes the open end 66. In this case, it can be observed that the lens 68 is transparent so as to enable light to be emitted from the lighting device $L_1$ in a form of a collimated beam. Furthermore, a rubber or similar O-ring can be disposed about the lens 68 in order to provide a water-tight arrangement in a conventional manner.

Provided for fitted disposition within the end cap 62 is a reflector arrangement 70. The reflector arrangement 70 is more fully illustrated in FIGS. 6–10 of the drawings. In this case, the reflector arrangement 70 comprises a polished reflector 72, having a central opening 74 for receiving a light bulb or similar light source 46. In this way, the light bulb can literally project through and into the polished reflector 72 in the arrangement as illustrated in FIG. 9 of the drawings.

The polished reflector 72 is fitted within a retaining ring 76 which effectively holds the polished reflector 72 within the end cap 62. When the components, as shown in FIG. 5, are assembled together, they will initially assume the arrangement, as shown in FIG. 9 of the drawings. In this way, it can be observed that the light source 46 literally projects through the central opening 74 in the polished reflector 72 and is closely disclosed to the lens 68. Thus, when the light source 46 is energized, light will be projected outwardly through the lens 68 in a somewhat collimated beam of light in the same manner as a conventional flashlight.

The fitting 44 is provided with a projection or so-called "key" 80 and which fits within an elongate groove or key-way 82 formed in the elongate sleeve 52 and a similar slot or key-way 84 formed in the retaining ring 76. In this way, the elongate sleeve 52 and the reflector arrangement 70 can be properly aligned in the correct position with regard to the housing or elongate handle 30. Moreover, it can be observed that there is only a limited degree of movement of the head section 42 with respect to the elongate handle 30. When the interior surface of the flat wall of the slidable coupling 50 engages the fitting 44, the slidable coupling 50 cannot be shifted to the left any further or off of the elongate handle 30. Hence, the shifting movement of the slidable coupling 50 to the left limits the outwardly extendable movement of the elongate sleeve 52 and the end cap 62. Contrariwise, shifting in the opposite direction will cause the polished reflector 72 to literally abut against the flat wall of the lens 68. In this way, there is a limited degree of movement axially of the head section 42.

By further reference to FIGS. 9 and 10 of the drawings, it can be seen that the lighting device $L_l$ is highly effective in operating as a flashlight when the head section is shifted to the right, reference being made to FIGS. 2–4 and 9 of the drawings. In this arrangement, the light source 46 extends through the polished reflector 72 and generates a collimated beam of light, as previously described. However, when it is desired to operate the lighting device $L_1$ as a lantern or lamp, the head section 42 is shifted to the left, reference being made to FIGS. 2–4, and 9 and 10 of the drawings. In this way, it can be observed that the light source 46 is located within the elongate sleeve 52. Further, in order to control left-hand limiting movement, the elongate handle 30 could be provided with a pair of abutments or stops 88.

The elongate sleeve 52 is preferably translucent so as to create a diffusion of the light, as aforesaid. FIG. 18 illustrates one embodiment of a cylindrically shaped sleeve 90 which may have a plurality of axially extending splines or ridges throughout the entire circumference of the cylindrically shaped sleeve 90. In this case, if the splines are closely spaced apart from one another, the light from the light source 46 will be substantially diffused. However, other surface configurations may also be employed in order to obtain the diffusing effect. Any type of surface grating arrangement may be employed for this purpose.

Also in connection with the present invention, the surface of the cylindrically shaped sleeve 90 may be imprinted with a design, as aforesaid. In this case, the design may be molded directly into the cylindrically shaped sleeve 90 itself or otherwise formed during the fabrication thereof. In effect, any type of design may be employed as, for example, an animal, an object, etc.

It can be observed that light emanating from the lens 68 is axially directed generally as a beam. The light passing through the cylindrically shaped sleeve 90 is not only diffused, but it is radially directed in substantially all directions. In this way, the lighting device $L_1$ functions very effectively as a lantern or a lamp. Moreover, the same lighting device $L_1$ is effective as a signaling device. If the cylindrically shaped sleeve 90, or otherwise the elongate sleeve 52 is formed of a colored material, even though translucent as, for example, red, green, blue or orange, the lighting device $L_1$ is very effective as a signaling device. This is even more the case when a sequencer is utilized.

The elongate sleeve 52 and the elongate cylindrically shaped sleeve 90, as well as the lens 68 may all be formed of a conventional transparent plastic material. However, these components could also be formed of glass, if desired. Furthermore, the entire outer housing of the lighting device could be suitably formed of well-known plastic materials such as polyethylene, polystyrene, various acrylic resins or the like. In addition, the housing components can be formed of metal or other known structural materials.

By further reference to FIGS. 3 and 4, the fitting 44 or, for that matter, the adapter 48 may contain a thin disc having a circuit imprinted thereon. This circuit would be in the form of a printed circuit and would contain a conventional sequencing arrangement. The concept of a sequencing circuit is well known in the art. However, one form of a sequencing circuit in combination with a switching mechanism is illustrated and described in further detail hereafter.

In co-pending U.S. patent application Ser. No. 782,983, filed Oct. 28, 1991, there is described a rotary switch mechanism useful in miniature hand-held flashlights for turning a bulb on or off in accordance with rotation of the head with respect to the casing. In this case, the switch device is effective regardless of the rotational direction. That rotational switch device is also effective for use in the present invention for turning the device on or off. In order to use the sequencing circuit, the rotary switch could be incorporated with a third position for operating the sequencing circuit. Otherwise, a separate switch apart from the rotary switch may be provided on the casing for operating the sequencing circuit. Further, a three position switch may also be mounted on the casing as hereinafter described in more detail.

FIGS. 11 and 12 illustrate another embodiment of a lighting device $L_2$ constructed in accordance with and embodying the present invention. The lighting device $L_2$ is almost identical to the lighting device $L_1$ except that the lighting device $L_2$ is provided with a slightly different end cap 94. The end cap 94 is similar to the end cap 62, except that it is provided with an internally threaded section 96 for receiving an externally threaded diametrically reduced section 98 on an elongate additional sleeve 100 which is preferably, although not necessarily, cylindrically shaped. In this case the elongate sleeve 100 may be similar to the elongate sleeve 52 in both construction and operation. The elongate sleeve 100 is also designed to cause a distribution of light which passes axially through the lens 68. Thus, when light passes through the lens 68 it will be introduced into the interior chamber 32 formed by the sleeve 100 where the light may be diffusely transmitted through the sleeve 100. For this purpose, a removable end plate 102 is provided and secured over the outer end of the sleeve 100.

The sleeve 100 may be used when the lighting device is only operable in a flashlight mode so that light passes from the light source 46 through the lens 68. Otherwise, it can also be used in combination with the elongate sleeve 52. As indicated previously, some light will still pass through the lens 68 when the light source is actually located intermediate to the ends, that is, within the elongate sleeve 52, as shown in FIG. 10. In this way, both sleeves 52 and 100 will generate radially dispersed light.

The remaining portions of the lighting device $L_2$ are substantially identical to the lighting device $L_1$ and are therefore neither illustrated nor described in further detail in connection with this lighting device $L_2$. Further, the lighting device $L_2$ can include essentially all of the other modifications adaptable with the lighting device $L_1$.

FIG. 14 illustrates another modified form of lighting device $L_3$. In this case, the lighting $L_3$ is substantially similar to the lighting device $L_1$ or the lighting device $L_2$ except that the lighting device $L_3$ has a sleeve 104 of a hexagonal or octagonal shape in cross section. Obviously, this embodiment is only illustrative of numerous shapes which the sleeve 104 can adopt. FIG. 15 illustrates an embodiment of a lighting device $L_4$ which differs only from the previous embodiments in that there is a sleeve 106 which has diamond shape configuration on its exterior surface. It should be understood that the sleeve 106 itself could also be used to convey messages as, for example, advertising messages or the like. Furthermore, the sleeve 106 may also be used to provide certain decorative effects, as indicated. In addition, the sleeve 106, depending upon the design, could be used to segregate the light device $L_4$ into different price ranges, such that one with a diamond shaped appearance might be decorated with gold trim or the like to become a more expensive or sophisticated type of lighting device.

It should also be understood that the outer sleeve 100, which is shown in the embodiment in FIGS. 11 and 12, could also be curved. Thus, there is an embodiment $L_5$ which is similar to the embodiment $L_2$, except that it uses an outer sleeve 110 which is curved and arcuate in shape, as shown in FIG. 13, while the outer sleeve 100 is cylindrical and elongate along a linear central axis. Here again, this embodiment of the device $L_5$ merely illustrates the numerous types of shapes and configurations that either sleeve may adopt.

FIG. 16 illustrates a lighting device $L_6$ which is triangular in cross section. In this case, this embodiment $L_6$ is illustrative of the fact that the lighting device can adopt numerous other shapes. For example, the lighting device itself could be not only circular in cross section or triangular in cross section, as shown, but it could be trapezoidal in cross section or, for that matter, it could have an irregular cross section. For example, the lighting device could adopt the shape of a fish, if desired.

FIG. 17 illustrates a further embodiment of a lighting device $L_7$ which is similar to the previous embodiments, except that this lighting device $L_7$ includes a solar cell 112 on the surface of the elongate handle 30. This solar cell 112 would be connected to the electrical circuit operating the lighting device $L_7$ or connected directly to the light source 46 itself. Usually, with solar cell-type operations, a conditioning circuit would receive the output of the solar cell 112. These circuits are conventional in construction and again, would be located on a simple metal disc located within the fitting 44 or the adapter 48.

It should be understood that the lighting device of the present invention could be provided with an aperture on the removable cap 36 for receiving a mounting device. For example, the end cap 36 could be suitably provided with a threaded opening for receiving a threaded stud on a suction cup for a screw-type attachment. In like manner, other types of mounting devices, including a bayonet-type mount, or a tripod-type mount could be employed. Further, a stake may be provided for removable attachment to an end of the handle and for driving the stake into the ground to thereby support the lighting device in an upright condition. In this way, the lighting device of the present invention can be mounted on and secured to a fixed structure. In like manner, a suction cup could be used for mounting the lighting device on a car roof. In the latter embodiment, the lighting device would effectively serve as a warning device to other traffic, or as an emergency distress signal device.

FIG. 19 represents a schematic view of one form of circuit which may be used in the lighting device of the present invention. As indicated previously, a three-way switch could be incorporated on the side of the case, if desired, or it could actually be incorporated in the head of the case in the manner as described in the aforesaid co-pending patent application. Further, separate switches could be used, if required.

In the case of the three-way switch which may be used in the present invention, that is an off position and on position and a signaling position, a switch 120 is employed, as shown in FIG. 19. This switch is a double pole double throw switch and comprises two-arms with three switch positions, as shown and where both arms of the switch are ganged together. Furthermore, the switch is shown as being connected to a battery source of power, such as the one or more conventional dry cell batteries 24. In the double-pull double-throw switch 120, the center contact located at each contact arm constitutes an off position. One of the opposite end contacts at each of the arms will serve as an on position and the opposite end contact at each of the arms will operate in the blinking or sequencing position.

A pair of transistors 122 and 124, as well as resistors 125, 126 and 128 and capacitors 130 and 132 constitute an oscillator circuit. As the transistor 124 turns on and off, it will energize the light 46 in an oscillating or blinking action. The light 46 is connected to the oscillator circuit through the switch 120 as shown. When the switch 120 is in the non-sequencing circuit position, the light 46 is connected to a current-limiting resistor 134 and the oscillator circuit is bypassed.

As indicated previously, a frequency control can be provided with the circuitry of the invention so that a user may adjust the frequency of a blinking or strobing effect. In like manner, a sensitivity control circuit can be connected to the electrical circuit of the device in order to control light output as a function of ambient light conditions. This is particularly effective for parties who must examine a document or other element in a somewhat dim light environment and then immediately look into a much darker environment. As an example, a pilot in an aircraft would not want any light brighter than the lights on the avionics panel, since that pilot must, after examining anything within the cockpit, immediately scan much darker external flight conditions. Finally, a darkness sensor could also be connected to the electrical circuit in order to automatically energize the lighting device when ambient light conditions reached a certain level.

Thus, there has been illustrated and described a unique and novel lighting device which is capable of operation as a signaling device, or as a lantern, or as a flashlight. Thus, the device of the present invention fulfills all of the objects and advantages which have been sought therefor. It should be understood that many changes, modifications, variations and other uses and applications will become apparent to those skilled in the art after considering this specification and the accompanying drawings. Therefore, any and all such changes, modifications, variations and other uses and applications which do not depart from the spirit and scope of the invention are deemed to be covered by the invention which is limited only by the following claims.

Having thus described the invention, what I desire to claim and secure by letters patent is:

1. A miniature hand-holdable multi-function lighting device which is capable of operation as a flashlight and as a lantern, said lighting device comprising:

a) an elongate housing;

b) a head mounted on and extended axially outwardly from said housing and being shiftable with respect to said housing;

c) a reflector in said head and having a convex outwardly presented surface;

d) a sleeve capable of transmitting light radiation located intermediate said housing and said head and being shiftable with said head and with respect to said housing;

e) a light source mounted on said housing and being located so that said light source can project through said reflector and bounce light off of said reflector to provide a generally columinated beam of light from said head, said sleeve and head being shiftable axially forwardly so that said light source is retracted from said reflector and shifted rearwardly from said reflector by a substantial distance so that said light source is locatable intermediate said sleeve and projects substantially all of the available light transversely through the sleeve when said sleeve and head are shifted axially forwardly so that the device is capable of operation as a lantern; and f) an additional sleeve is provided for connection to said head to extend outwardly from said head.

2. The lighting device of claim 1 further characterized in that said head is opaque and provided with a forwardly directed opening at one end and the reflector has its convex surface at that end.

3. The lighting device of claim 1 further characterized in that a coupling is located on one end of said sleeve and is also slidable along said housing, said coupling having means for controlling the limit of movement of said sleeve and said head.

4. The lighting device of claim 1 further characterized in that said sleeve is cylindrical in cross section.

5. The lighting device of claim 1 further characterized in that said sleeve has a non-circular cross sectional shape.

6. The lighting device of claim 1 further characterized in that said sleeve has an irregular surface configuration thereon.

7. The lighting device of claim 1 further characterized in that said sleeve is provided with a textured surface in order to diffuse light passing therethrough.

8. The lighting device of claim 1 further characterized in that said housing has a tubular chamber for holding one or more batteries as a source of electrical power.

9. A lighting device which is capable of operation as a flashlight so that light can extend axially therefrom in somewhat of a collimated beam and which can also permit a controlled passage of radial light in place of, or in addition to, the axial transmission of light, said lighting device comprising:

a) an elongate housing;

b) a head located forwardly of said elongate housing and being essentially co-axial with said elongate housing, said head being comprised of:

1) an opaque casing having an open forward end, and

2) a transparent face plate located at said open forward end permitting an axial transmission of light therefrom;

c) a reflector located within said opaque casing and having a convex surface facing forwardly thereof toward said transparent face plate;

d) a lens section on said housing located between said housing and said head and extending axially with respect to the housing and which lens section is translucent or transparent to permit light distribution therethrough;

e) a light source mounted on said housing and capable of being located with respect to the translucent or transparent lens section for radial transmission of light therethrough and also with respect to the reflector for axial transmission of light;

f) axially shiftable means enabling the light transparent or translucent lens section and the head with the reflector to be shifted inwardly by pure axial sliding movement so that the light source may be positioned at the reflector such that light may be directed axially, said positioning means also enabling axial sliding movement of the head with the reflector and the lens section so that the light source may be positioned in the lens section to provide a substantial amount of radial light dissipation and with only a very limited and controlled amount of axial light distribution;

g) said lens section being removable from its position between the head and the housing so that a new lens section can be used in place thereof; and h) switch means associated with said housing to turn said lighting device off and on and which switch means is operable by rotatable action of turning the housing with respect to the head and lens section to energize and de-energize the light source and thereby turn the device on and off.

10. The lighting device of claim 9 further characterized in that said reflector is adapted to receive said light source in a position where it is located in said convex surface for use in operation as a flashlight.

11. The lighting device of claim 9 further characterized in that said light source becomes separated from said reflector and is withdrawn substantially rearwardly thereof and permits only a very small amount of axially directed light to pass through said opening when said head and lens section is shifted forwardly with respect to said housing.

12. A miniature hand-holdable multi-function lighting device which is capable of operation as a flashlight and as a lantern, said lighting device comprising:

a) an elongate housing;

b) a head mounted on and extended axially outwardly from said housing and being shiftable with respect to said housing;

c) a sleeve capable of radially transmitting light radiation located intermediate said housing and said head and being shiftable with said head and with respect to said housing;

d) a light source mounted on said housing and being located in proximity to an end of said head in which light can pass axially therefrom as a beam, said head and sleeve being shiftable axially forwardly with respect to said housing and light source so that said light source is also locatable within said sleeve when said sleeve and head are shifted such that the device is capable of operation as a lantern;

e) a slidable coupling secured to said sleeve at a rearward end thereof and being shiftable with said head and sleeve and with respect to said housing, but which allows non-rotatable sliding shiftable movement of the head and sleeve with respect to the housing;

f) an enlarged element on said housing and being engagable with an end of said coupling to control and limit forward movement of the sleeve and the head; and g) means also limiting rearward movement of the head and sleeve during such rearward movement of said head and sleeve.

13. The lighting device of claim 12 further characterized in that said sleeve is provided with a keyway and said coupling is provided with a key extending in said keyway to permit and provide forward movement of said head and sleeve with respect to said housing.

14. The lighting device of claim 23 further characterized in that said keyway is linear and parallel to the axis of the device.

15. The lighting device of claim 12 further characterized in that said light source becomes separated from said reflector and permits only a small amount of axially directed light to pass from said head when said sleeve and head are shifted axially forwardly with respect to said housing.

* * * * *